US005194022A

United States Patent [19]

Enomoto

[11] Patent Number: 5,194,022

[45] Date of Patent: Mar. 16, 1993

[54] ELECRICAL CONNECTOR

[75] Inventor: Ikuo Enomoto, Machida, Japan

[73] Assignee: AMP Incorporated, Harrisburg, Pa.

[21] Appl. No.: 739,713

[22] Filed: Jul. 17, 1991

Related U.S. Application Data

[63] Continuation of Ser. No. 571,959, Aug. 23, 1990, abandoned.

[30] Foreign Application Priority Data

Dec. 30, 1988 [JP] Japan ..... 63-332574

[51] Int. Cl.[5] ..... H01R 11/22

[52] U.S. Cl. ..... 439/851; 439/856

[58] Field of Search ..... 439/751, 444, 856, 857, 439/861, 862

[56] References Cited

U.S. PATENT DOCUMENTS

| | | | |
|---|---|---|---|
| 2,575,161 | 11/1951 | Deakin | 439/857 |
| 3,665,378 | 5/1972 | Hammell et al. | 439/857 |
| 3,997,236 | 12/1976 | Bresin | 339/221 R |
| 4,469,387 | 9/1984 | McHugh | 339/42 |
| 4,597,625 | 7/1986 | Seidler | 439/444 |
| 4,614,400 | 9/1986 | Tesch | 439/444 |
| 4,682,829 | 7/1987 | Kunkle et al. | 439/83 |
| 4,690,479 | 9/1987 | Hollyday et al. | 439/97 |
| 4,693,528 | 9/1987 | Asick et al. | 439/83 |
| 4,717,354 | 1/1988 | McCleerey | 439/444 |
| 4,857,017 | 8/1989 | Erk | 439/695 |
| 4,941,852 | 7/1990 | Costa | 439/733 |

FOREIGN PATENT DOCUMENTS

| | | | |
|---|---|---|---|
| 268824 | 10/1987 | European Pat. Off. | 13/436 |
| 7815430 | 10/1976 | Fed. Rep. of Germany . | |
| 1374300 | 11/1963 | France . | |
| 1515112 | 3/1968 | France | 439/862 |

*Primary Examiner*—Larry I. Schwartz
*Assistant Examiner*—Hien D. Vu
*Attorney, Agent, or Firm*—Adrian J. LaRue; Timothy J. Aberle

[57] ABSTRACT

An electrical connector comprises an insulation housing (30) having a plurality of contact-receiving cavities (33) in which electrical contacts (10, 10') are to be inserted and secured. Each of the contacts (10, 10') includes a base section (11, 11') for engaging with a first wall (31*a*) of the cavity (33), a contact-receiving section (12), a conductor-engaging section (13) and an engaging section (14, 14') having engaging members (22, 22') being pressed into channels (34) in the third and fourth walls (32*a*, 32*b*) of the cavity (33) thereby securing the contact (10, 10') in the cavity (33). Wing members (15) have ends (15*a*) disposed in spaces (38) in the cavity (33).

19 Claims, 3 Drawing Sheets

ELECRICAL CONNECTOR

This application is a continuation of application Ser. No. 07/571,959 filed Aug. 23, 1990, now abandoned.

The present invention relates generally to an electrical connector, more specifically to a connector having female electrical contacts for receiving complementary mating male contacts and particularly suited for compact and high-density requirements.

In a conventional connector having female electrical contacts to receive complementary mating male electrical contacts, the female electrical contacts in a plurality of parallel contact-receiving cavities in an insulation housing are secured therein by sharp projections formed at both sides of such contacts to engage inner walls of the cavities and by forming box-shaped support sections near openings of the contact-receiving cavities for insertion of complementary mating male electrical contacts However, the housing tends to be curved or deformed due to strong forces by the projections at both sides of the female electrical contacts to the walls defining the contact-receiving cavities and also due to a large number of electrical contacts inserted in the contact-receiving cavities arranged in one direction. As a result, the securing of the contacts in this manner in the contact-receiving cavities adversely affect them thereby resulting in an inaccurate pitch of the contacts. Additionally, female electrical contacts having box-shaped support sections are relatively bulky, thus, they are not desirable to meet miniature and high-density requirements for a connector and difficult to reduce production costs due to relatively thicker metal required for the contacts.

The present invention intends to solve the above problems. For this end, the electrical connector according to the present invention comprises an insulation housing having a plurality of contact-receiving cavities with first and second openings between first and second ends thereof, and female electrical contacts to be inserted in the cavities from the first openings thereof. Each contact is made from an electrically-conductive metal plate by stamping and forming and comprises a base section having first and second surfaces and first and second ends, and an engaging section to secure it to walls of the cavities. The base section extends along the axis of each female electrical contact and the first surface engages with the first wall of each cavity. A pair of resilient arms defining the contact-receiving section extend from support sections bent relative to the second surface from both sides of the base section at the first end thereof toward the second end of the base section. Raised edges formed at the support sections engage the second wall opposite to the first wall of the cavity. Engaging members constituting the engaging section extend from both sides of the base section adjacent to the first end of the base section and are pressed into channels of a predetermined length formed in opposing third and fourth walls of the cavity in the housing from the first end to the second end. Wing members formed at both sides of the base section at the second end thereof engage the third and fourth walls at both sides of the first wall of the cavity adjacent the second opening of the cavity or are pressed into gaps formed between the first wall adjacent to the second opening of the cavity and the third and fourth walls crossing the first and second walls.

In a preferred embodiment, the engaging strip ends of the engaging section are twisted to an angle with respect to the extension of the engaging strip to provide resiliency to planar pressure and the height of the strip ends is chosen to be greater than the height of the channels.

In another embodiment, engaging members of the engaging section are separated in a stepped manner to provide resiliency to planar pressure with the height of the separated engaging members being greater than the height of the channels.

In addition, the wing members of the base section have bent ends relative to its first plane to provide planar pressure at the bent ends.

In the connector according to the present invention, the engaging members constituting the engaging section of the female electrical contact are pressed into the channels in the housing, the base section of the contact engages the wall of the contact-receiving cavity, the upper edges at the support sections of the contact engage the wall of the cavity opposite to the first-mentioned wall, and the wing members formed at both sides of the body section distant from the support sections engage with both walls crossing the aforementioned two walls, thereby totally stably securing the contact in the housing.

The connector according to the present invention will be described in detail hereinafter by way of example with reference to the accompanying drawings.

Figure 1:
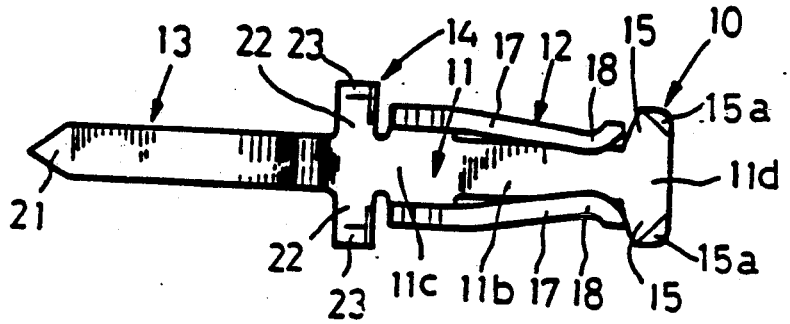
FIG. 1 is a top plan view of a contact of the connector of the present invention.
Figure 2:
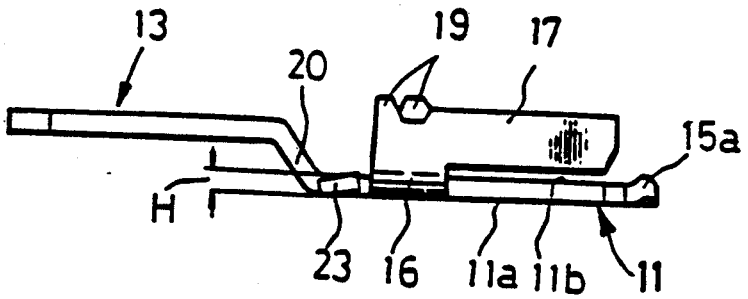
FIG. 2 is a side elevational view of the contact in FIG. 1.
Figure 3:
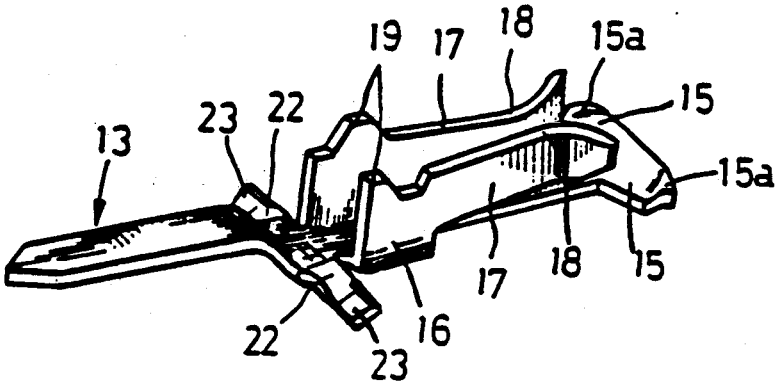
FIG. 3 is a perspective view of the contact of FIG. 1.

FIGS. 1 through 3 show female electrical contact 10 made of an electrically-conductive metal plate by stamping and forming techniques. Contact 10 comprises base section 11, complementary male electrical contact-receiving section 12, leg, post or conductor-engaging section 13 and engaging or contact-securing section 14.

Base section 11 extends substantially horizontally along the axis of contact 10 and is defined by first and second surfaces 11*a*, 11*b*, first and second ends 11*c*, 11*d* and has wing members 15 at both sides of second end 11*d*.

Wing members 15 have bent ends 15*a* to first surface 11*a* of base section 11 to provide resiliency to planar pressure.

Contact-receiving section 12 comprises a pair of resilient contact arms 17 extending from support sections 16 toward second end 11*d* of base section 11. Support sections 16 are formed from both sides of first end 11*c* of base section 11 at substantially right angles thereto. The pair of resilient contact arms 17 are separated at their lower edges in FIG. 2 from second surface 11*b* of base section 11 and are biased to have a narrower distance therebetween toward their free ends from support sections 16 as shown in FIG. 1. Also, resilient contact arms 17 are curved outwardly near their free ends so that curved sections 18 act as contact points when engaged with a complementary male electrical contact.

As best shown in FIG. 2, projections 19 extend higher than the upper edges of contact arms 17 above support sections 16. Post section 13 extends substantially straight in alignment with the center lines of contact arms 17 but in an opposite direction to wing members 15 from first end 11c of base section 11 by way of bent section 20 adjacent first end 11c and terminates with a sharp end 21. Engaging section 14 is constituted by engaging members 22 extending from both sides of base section 11 adjacent first end 11c. Engaging members 22 have twisted ends 23 having a height H greater than the thickness of base section 11 and twisted at an angle with reference to the axis corresponding to the extension of engaging members 22, thereby providing resiliency to planar pressure.

Figure 4:
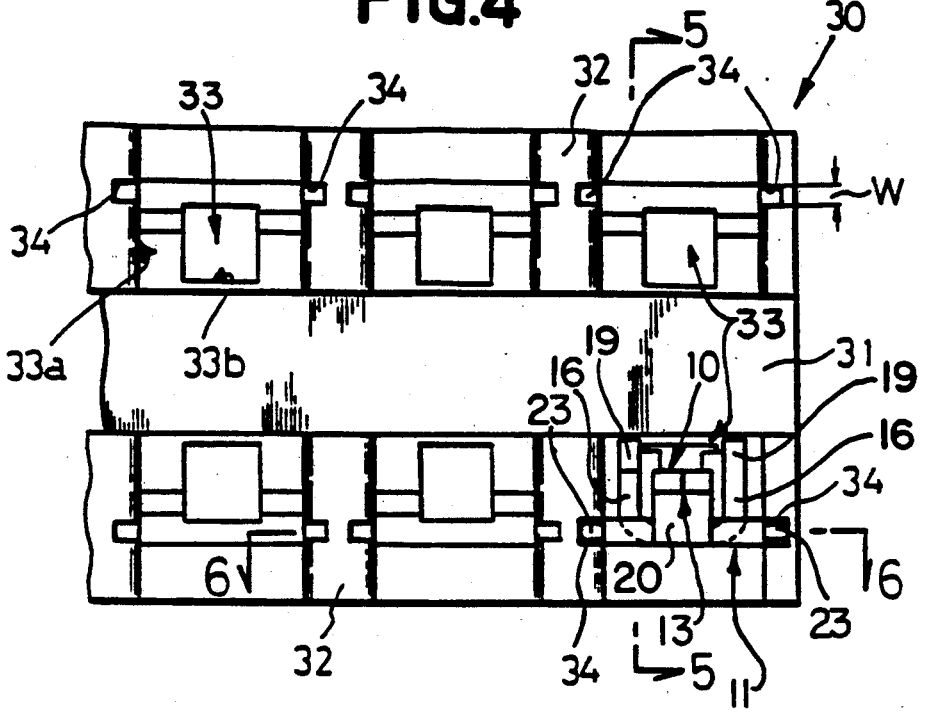
FIG. 4 is a plan view of a housing of the connector seen from the back side.
Figure 5:
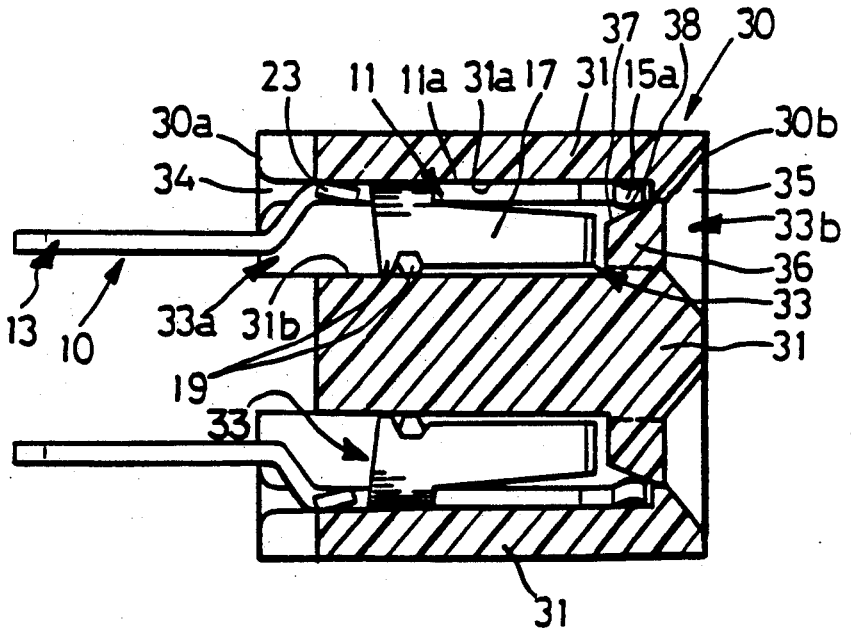
FIG. 5 is a cross-sectional view taken along line 5—5 in FIG. 4.
Figure 6:
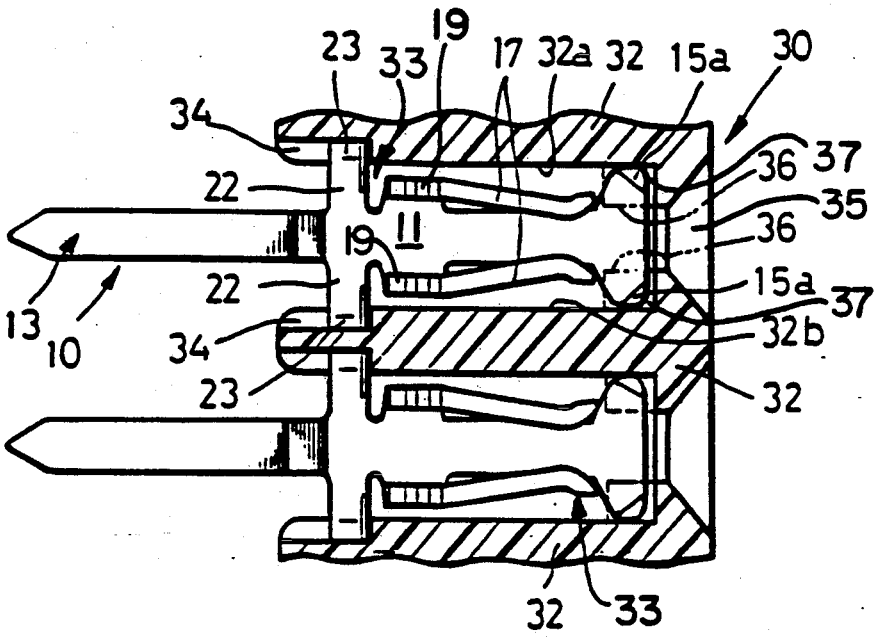
FIG. 6 is a cross-sectional view taken along line 6—6 in FIG. 4.

Shown in FIG. 4 is insulation housing 30 for assembling contacts 10 therein. In FIGS. 5 and 6, contacts 10 are assembled in insulation housing 30. Housing 30 is made of a suitable plastic material or the like by molding and has first end 30a and second end 30b. Housing 30 contains many contact-receiving cavities 33 separated into two rows by horizontal wall 31 and several columns by vertical walls 32, so that each cavity 33 is defined by four walls, namely first and second walls 31a, 31b and third and fourth walls 32a, 32b crossing first and second walls 31a, 31b. Each cavity 33 has first and second openings 33a, 33b. Channels 34 of a predetermined length are formed in both walls 32a, 32b of each cavity 33 near first opening 33a and extend from first end 30a toward second end 30b of housing 30. Width W of each channel 34 is chosen to be narrower than the height H of engaging members 23 of engaging section 14. Flange 35 is formed at second opening 33b of each cavity 33. Projections 36 having sloped surfaces 37 are formed on third and fourth walls 32a, 32b of each cavity 33 near second opening 33b, thereby forming spaces 38 between sloped surfaces 37 and first wall 31a.

In cavities 33 of housing 30 of the above construction, a plurality of contacts 10 are inserted from the first opening 33a side with wing members 15 leading. In installing contacts 10, engaging members 23 are forced along channels 34 against their resiliency until they engage the members 23. Also, first surfaces 11a of base sections 11 engage walls 31a, projections 19 of support sections 16 engage walls 31b opposing walls 31a, and bent ends 15a of wing members 15 engage walls 32a, 32b and/or are pressed into spaces 38 against their resiliency. Post sections 13 extend externally from first ends 30a of housing 30.

Figure 7:
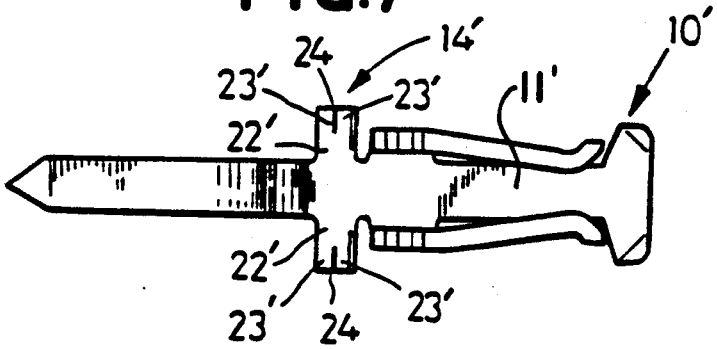
FIG. 7 is a top plan view of another embodiment of the contact.
Figure 8:
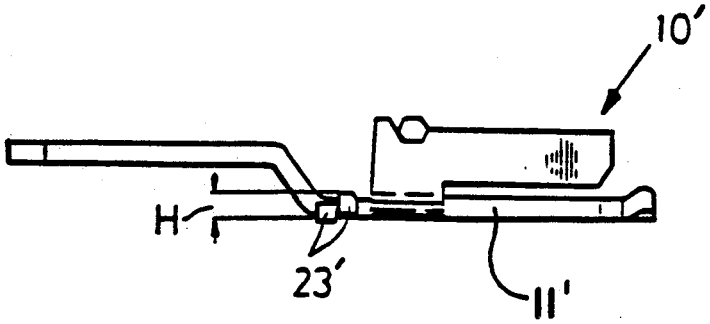
FIG. 8 is a side elevational view of the contact in FIG. 7.

Shown in FIGS. 7 and 8 is another embodiment of contact 10. Contact 10' in this alternative embodiment features dividing ends 23' of engaging members 22' of engaging section 14' into two parts by slits 24 and biasing one part from the other in a stepped manner to provide resiliency to planar pressure. Height H of engaging ends 23' is chosen to be greater than width W of channels 34 and the thickness of base section 11'. Shape and construction of contact 10' are identical to those of contact 10 in all other sections.

As mentioned hereinbefore, engaging ends 23, 23' are preferably twisted or formed in a stepped manner, but they may be simply made to be slightly thicker than the width of the channels in which they are to be secured. Also, wing members 15 are preferably made to have bent ends 15a to be forced in spaces 38 but may be designed to be pressed therein without forming bent ends 15a. In some instances, ends of the wing members may be frictionally pressed against both walls 32a, 32b.

The connector as described herein may be used, for example by inserting post portions 13 of female electrical contacts 10 into holes of a printed circuit board and electrically connected with male electrical contacts of a complementary mating connector by inserting such male electrical contacts in contact-receiving sections 12 of contacts 10.

In accordance with the connector of the present invention, in addition to pressurized insertion of the engaging members constituting the engaging section of the female electrical contact into the channels in the housing, the base section of the contact engages with the wall of the contact-receiving cavity in the housing, the projections at the support sections of the contact engage the wall opposite to the first mentioned wall of the cavity, and the wing members at both sides of the base section distant from the support sections also engage two walls crossing the above two walls and/or are pressed into the spaces formed near the second opening of the cavity. As a result, the female electrical contact is entirely and reliably stabilized in the housing, thereby avoiding physical instability of the contact in the cavity when mating or unmating the connector with a complementary mating connector. Additionally, the connector according to the present invention helps to avoid curving or deformation of the housing and irregular alignment of adjacent contacts because the engaging members of the engaging section apply pressure only to the channel width direction, i.e., the housing height direction. Since more contact cavities are generally formed in the length direction than the height direction of the housing, the present invention is particularly effective for those connectors having a large number of contacts.

If the engaging ends of the engaging section are twisted or separated and formed in a stepped manner to provide resiliency and to have a greater height than width of the channels, the frictional strength between the channels increases thereby strengthening the engagement between the engaging members and the channels and, in turn, reliably securing the female electrical contacts in the housing.

Also, the bent ends at the wing members of the base section provide resiliency to planar pressure, thereby strongly stabilizing the contact in the housing, if they are pressed in the spaces.

I claim:

1. An electrical connector comprising an insulation housing (30) having a plurality of electrical contact-receiving cavities (33) with first and second openings (33a,33b) between first and second ends (30a,30b), and electrical contacts (10,10') to be inserted in said cavities (33) through the first openings (33a), each of said contacts including a base section (11) having first and second surfaces (11a,11b) and first and second ends (11c,11d), and electrical contact-receiving section (12), a conductor-engaging section (13), and an engaging section (14,14') for engaging opposing walls (32a,32b) of a respective cavity (33), characterized in that said base section (11) extends in an axial direction of said female electrical contact (10,10') with the first surface (11a) of said base section (11) engaging a first wall (31a) of the cavity (33), a pair of resilient contact arms (17) of said contact-receiving section (12) extending forwardly from opposed support sections (16) adjacent said first end (11c) of said bas section (11), and engaging members

(22) defining said engaging section (14) extending beyond both sides of said base section (11) in substantially the same plane of said base section adjacent said first end (11c) and being pressed into channels (34) of predetermined length in third and fourth walls (32a,32b) of said cavity (33), said engaging members having a height greater than the width of said channels.

2. An electrical connector as claimed in claim 1, characterized in that the ends (23) of said engaging members (22) are twisted to a predetermined angle with respect to the axis of said engaging section (14) to provide resiliency to planar pressure, and the height (H) of the twisted ends (23) is greater than the width (W) of said channels (34).

3. An electrical connector as claimed in claim 1, characterized in that the ends (23') of said engaging members (22') are separated in a stepped manner to provide resiliency to planar pressure, and the height (H) of the separated ends (23') is greater than the width (W) of the channels (34).

4. An electrical connector as claimed in claim 1, characterized in that wing members (15) extend from both sides of said base section (11) adjacent said second end (11d) and engage the third and forth walls (32a, 32b) of said cavity (33).

5. An electrical connector as claimed in claim 4, characterized in that the ends 15a of said wing members (15) are disposed in spaces (38) between the first wall (31a) and the third and fourth walls (32a, 32b) of said cavity (33).

6. An electrical connector as claimed in claim 4, characterized in that the ends (15a) of said wing members (15) are bent relative to the first surface (11a) of said base section (11) to provide resiliency to planar pressure.

7. An electrical connector comprising:

a dielectric housing having at least one contact-receiving passageway extending from a rear surface of the housing to a front surface thereof, said passageway having channels disposed in opposing walls adjacent another wall thereof;

an electrical contact disposed in said contact-receiving passageway and having a base section extending along the other wall; and engaging members at one end of said base section and extending outwardly beyond both sides of said base section in substantially the same plane as the base section, said engaging members having a height greater than the thickness of said base section whereby said engaging members pressingly engage opposing surfaces of said channels which are spaced apart at a distance less than that of the height of said engaging members thereby securing said contact in said contact-receiving passageway.

8. An electrical connector as claimed in claim 7, wherein at least outer ends of said engaging members are twisted with respect to the axis of the engaging members.

9. An electrical connector as claimed in claim 7, wherein at least outer ends of the engaging members are separated in a stepped manner.

10. An electrical connector as claimed in claim 7, wherein projections are located in said contact-receiving passageway adjacent said front surface on each side of an opening to said contact-receiving passageway, said projections being spaced from said other wall, wing members extending from both sides of said base section at another end thereof and being positioned between said projections and said other wall.

11. An electrical contact, comprising: a base section having upper and lower surfaces, a longitudinal axis, and outer and inner ends;

an electrical contact-receiving section including said base section, said contact-receiving section further includes support section means extending at substantially right angles to said base section, said support section means including at least one upwardly extending projection disposed thereon;

a conductor-engaging section spaced from said base section as a continuation thereof;

a securing section located between said contact-receiving section and said conductor-engaging section including a planar portion disposed in the same plane as said base section and engaging members as extensions of said planar portion extending outwardly beyond the sides of the base section, each of said engaging members being twisted in another plane at substantially the same angle relative to the plane of said base section wherein the height of the engaging members is greater than the thickness of said base section; and wherein said base section outer end extends axially beyond said at least one projection in a direction axially away from said engaging members.

12. An electrical contact as claimed in claim 11, wherein said engaging members are twisted to a predetermined angle with respect to the axis of said contact-securing section to provide resiliency to planar pressure.

13. An electrical contact as claimed in claim 11, wherein said engaging members are separated in a stepped manner to provide resiliency to planar pressure.

14. An electrical contact as claimed in claim 11, wherein wing members extend from both sides of said base section adjacent said outer end.

15. An electrical contact as claimed in claim 14, wherein ends of said wing members are bent out of the plane of said base section to provide resiliency to planar pressure.

16. An electrical contact for insertion into a contact-receiving passageway having channels disposed in opposing walls of a dielectric housing, comprising:

a contact section including a base section for disposition within the contact-receiving passageway having channels disposed in opposing walls of a dielectric housing, comprising:

a contact section including a base section for disposition within the contact-receiving passageway, said base section includes a longitudinal axis and inner and outer ends, and said contact section further including support section means extending at substantially right angles to said base section, said support section means including at least one upwardly extending projection disposed thereon;

a conductor-engaging section as a continuation of said base section and spaced from said contact section;

a securing section located between said contact receiving section and said conductor-engaging section including a planar portion located in the same plane as said base section and securing members as extensions of said planar portion extending outwardly beyond the sides of said base section and twisted at substantially the same angle relative to said base section, said securing members having a height greater than the thickness of said base section whereby said securing members are engagable with opposing surfaces of the channels which are spaced apart a distance less than that of the height of said securing members thereby securing the contact in the contact-receiving passageway; and wherein said base section outer end extends axially beyond said at least one projection in a direction axially away from said securing members.

17. An electrical contact as claimed in claim 16, wherein said securing members are twisted so as to be in a plane at an angle with respect to the plane of the base section.

18. An electrical contact as claimed in claim 16, wherein said securing members are separated in a stepped manner.

19. An electrical contact as claimed in claim 16, wherein wing members extend outwardly from both sides of said base section at a front end thereof.

* * * * *